United States Patent [19]

Barrash

[11] Patent Number: 4,523,676

[45] Date of Patent: Jun. 18, 1985

[54] MULTI-CONTAINER PACKAGE WITH OPTIONAL COVER AND METHOD FOR MAKING THE SAME

[75] Inventor: Marshall J. Barrash, Atlanta, Ga.

[73] Assignee: The Coca-Cola Company, Atlanta, Ga.

[21] Appl. No.: 565,793

[22] Filed: Dec. 27, 1983

[51] Int. Cl.[3] ..... B65D 85/62; B65D 75/56; B65D 71/02

[52] U.S. Cl. ..... 206/150; 206/428

[58] Field of Search ..... 206/150, 139, 145, 149, 206/160, 161, 192, 427, 428

[56] References Cited

U.S. PATENT DOCUMENTS

| | | | |
|---|---|---|---|
| 2,318,975 | 5/1943 | Morris et al. | 206/139 |
| 3,245,527 | 4/1966 | Martin | 206/427 |
| 3,302,783 | 2/1967 | Lyon | 206/150 |
| 3,307,692 | 3/1967 | Chidsey, Jr. | 206/150 |
| 4,385,690 | 5/1983 | Olsen | 206/150 |
| 4,423,810 | 1/1984 | Bader | 206/161 |

*Primary Examiner*—William T. Dixson, Jr.

*Attorney, Agent, or Firm*—Birch, Stewart, Kolasch & Birch

[57] ABSTRACT

A multi-container package and method for making the same including two six-pack assemblies of containers, a paperboard cover over at least a part of the multi-container package, and an elastic band encircling and securing together the two six-pack assemblies and the paperboard cover. The band includes a central stabilizing strap located between the two six-pack assemblies, and the paperboard cover includes a top panel formed of two separate sections interconnected by two intermediate panels which extend down in-between the two six-pack assemblies to accommodate and receive therebetween the central stabilizing strap.

12 Claims, 3 Drawing Figures

MULTI-CONTAINER PACKAGE WITH OPTIONAL COVER AND METHOD FOR MAKING THE SAME

BACKGROUND OF THE INVENTION

1. Field of the Invention

This invention relates to multi-container packages of preformed, plural container assemblies, and in particular to such a package and method for making the same having an optional paperboard cover that provides a dust cover and surface area for the product logo and promotional graphics.

2. Description of the Prior Art

In the prior art it is known to package soft drinks cans in a six-pack configuration of two rows of three cans each, such as is shown in U.S. Pat. Nos. 3,217,874 and 3,714,756.

It is also known to secure together a plurality of such six-pack assemblies, as shown in U.S. Pat. Nos. 4,385,690 and 4,385,691, by the use of an elastic band having a stabilizing strap. It is further known to provide a six-pack assembly with a paperboard top member secured by an elastic band as shown in U.S. Pat. Nos. 3,118,537 and 3,302,784.

It is an object of the present invention to provide a multi-container package of plural container assemblies, and method for making the same, wherein the package includes an optional paperboard cover that provides a dust cover and surface area for promotional information, and that can accommodate an encircling band that includes a stabilizing strap.

It is another object of this invention to provide such a package and method wherein the cover has notches to provide the cover with a smooth curved surface conforming to the container shape.

It is a still further object to provide such a package with a cover that is completely optional and that can be left off when not desired and that does not form part of the handle or securing means of the package.

SUMMARY OF THE INVENTION

A multi-container package of a plurality of preformed plural container assemblies, a cover over at least a portion of the package and including a top panel formed of a plurality of separate sections, each adjacent pair of sections being interconnected by a pair of intermediate panels extending away from the top panel down between a pair of adjacent ones of said assemblies, and a band encircling and securing together the plurality of assemblies, the band including a stabilizing strap extending between each adjacent pair of assemblies, and also located in-between said pair or intermediate panels.

BRIEF DESCRIPTION OF THE DRAWINGS

The present invention will be more fully understood from the detailed description below when read in connection with the accompanying drawings which are given by way of illustration only and thus are not limitative of the invention and wherein like reference numerals refer to like elements, and wherein.

DETAILED DESCRIPTION OF THE PREFERRED EMBODIMENT

Figure 1:
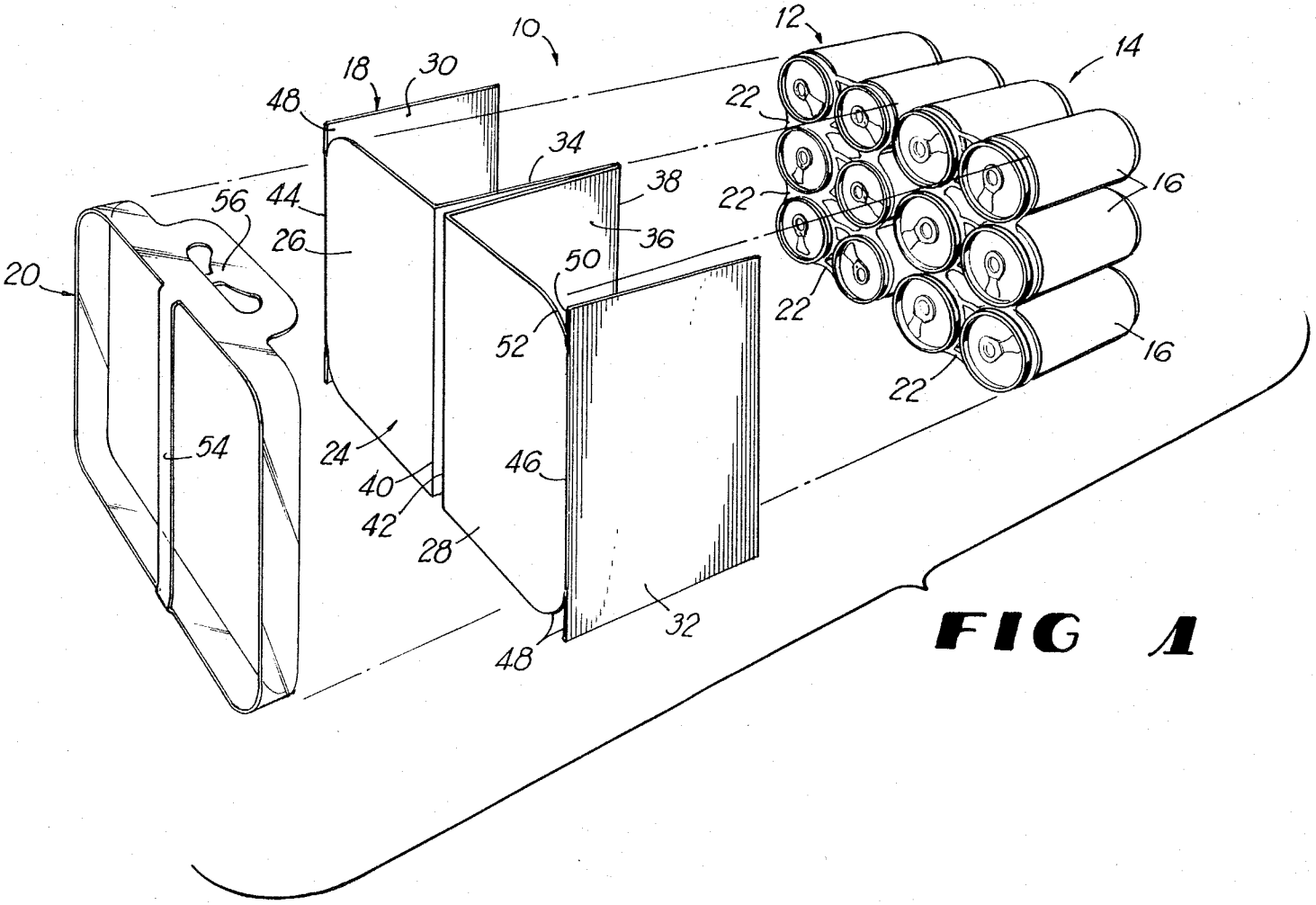
FIG. 1 is an exploded perspective view of the package of the present invention.
Figure 2:
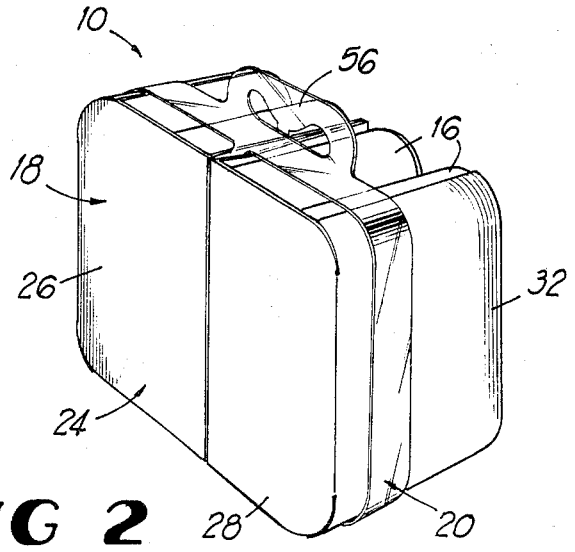
FIG. 2 is a perspective view of the package of FIG. 1 shown in its assembled state.
Figure 3:
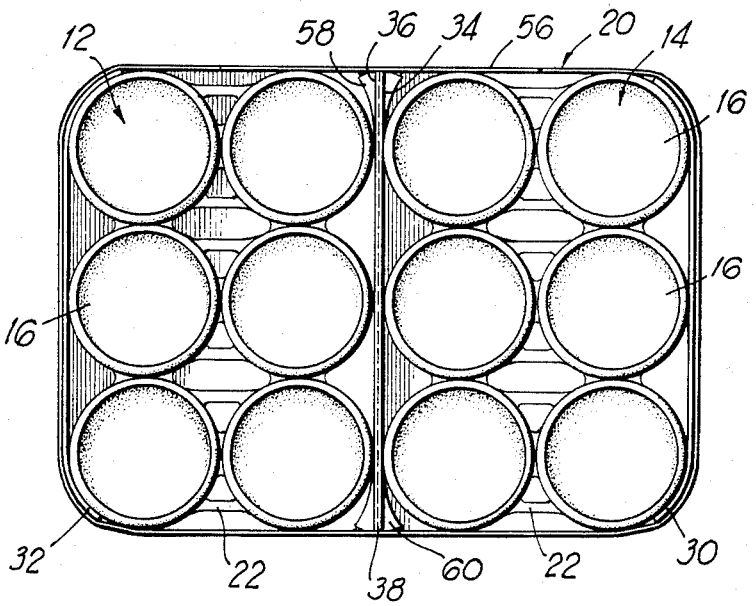
FIG. 3 is a bottom view of the package of FIG. 1.

With reference now to the drawings, FIGS. 1–3 show a multi-container package 10 according to the preferred embodiment of the present invention.

The package 10 includes a plurality of preformed plural container assemblies, in this embodiment a pair of six-packs 12 and 14 of cans 16, a cover 18, and a band 20 encircling and securing together the two six-packs and the cover as a single package 10.

The cans 16 in the individual six-packs 12 and 14 are preferably secured together by an elastic loop matrix 22 of a type well-known in this art.

The cover 18 is preferably of paperboard and includes a top panel 24 formed of two separated sections 26 and 28, a pair of side panels 30 and 32 connected to opposite ends of the top panel 24, and a pair of intermediate panels 34 and 36 that interconnect the two sections 26 and 28. The intermediate panels 34 and 36 are connected together at a hinge line 38 and are connected to the sections 26 and 28 at hinge lines 40 and 42, respectively. The side panels 30 and 32 are connected to the sections 26 and 28 at hinge lines 44 and 46. The hinge lines 44 and 46 each terminate at each end thereof short of the edge of the cover 18 at the apex of a notch 48. All of the four notches 48 are identical so a description of only one (the one located on the top right in FIG. 1) need be given. The notch 48 has a straight side 50 which is in-line with the hinge line 46 and a curved side 52 that conforms to the curvature of the cans 16.

The above-described structure of the cover 18 provides several advantages. The intermediate panels 34 and 36 allow the use of a band 20 of the type having a central or intermediate stabilizing strap 54. As shown in the drawings, the two intermediate panels 34 and 36 extend in-between the two six-packs 12 and 14 and the strap 54 extends in-between the two intermediate panels. The intermediate panels 34 and 36 thus accommodate and receive the strap 54 there-between during assembly of the package 10. Because of the notches 48 the cover 18 does not have any sharp or otherwise protruding corners which could be bent or torn and thus present an unsightly appearance. The resulting cover 18 as shown in FIG. 2 presents a smooth, clean shape and appearance conforming to that of the cans 16. The cover 18 provides a dust cover for the tops of the cans 16 and provides a surface area suitable for presenting the product logo, desired graphics, the product symbol, and couponing and/or other promotional messages, in a fashion similar to that of a 100% paperboard 12 can pack (which does not use an elastic band).

The band 20 can be any one of a number a well-known bands, such as a plastic band made of polyethylene, for example. The band 20 is stretched to encircle the two six-packs and the cover and is then released to grip the two six-packs and the cover and hold them securely together as a single package 10. The band 20 includes the central stabilizing strap 54 and a handle 56. The handle is laying flat in FIG. 3 and is shown extending upright in FIG. 2. FIG. 3 shows the two ends 58 and 60 of the strap 54 somewhat twisted. Intermediate these two twisted ends, the strap 54 lies flat between the two intermediate panels 34 and 36.

The cover 18 is optional in that it can be used when desired, for example, during promotional campaigns for the product in the containers and it can be omitted at other times, if desired, to save the expense of using the cover. When the cover 18 is used, it provides the same advantages of a 100% paperboard carrier for a 12-pack, but at less expense. The cover 18 does not include any handle structure, so that the omission of the cover does not affect how the remainder of the package is used.

The package 10 is assembled by locating a pair of six-packs side by side and then positioning the cover against the two six-packs with the two intermediate panels located in-between the two six-packs. The band 20 is then stretched and placed around the package. When the stretched band 20 is released, it firmly and securely holds the cover 18 in place while also holding the two six-packs together. When the cover 18 is moved into place onto the two six-packs it is held firmly in place against the two six-packs, for example, by means of spring-biased fingers while the band 20 is stretched into position over the package. After the band is released, it then holds the cover in place and the fingers are then released from contact with the cover.

The present invention has been described with reference to the preferred embodiment thereof, however, the invention is not limited only to such preferred embodiment. For example, while two six-packs are shown, three or more can be used. Also, the preformed plural container assemblies need not contain 6 containers; any number can be included in the assemblies including different numbers in each assembly. Any known method of securing the preformed plural assemblies can be used and not just the specific matrix 22 shown in the drawings. While the cover is preferably paperboard, other materials can be used. Also, the cover can include additional panels. While the intermediate panels and the side panels are shown extending the entire height of the cans, they can alternatively extend only just past the band. In fact, the strap 54 can abutt against the hinge line 38 located about midway of the height of the cans, to even more firmly hold the top panel in place. The band can be made of plastic or other materials and can be stretched and then released into place or it can be secured on the package in any other desired fashion. While preferably a single strap is used between each pair of assemblies, two or more such straps can be used, if desired. The containers can be cylindrical metal cans or any other desired containers of other shapes and/or materials.

What is claimed is:

1. A multi-container package comprising:

(a) a plurality of preformed plural container assemblies;

(b) a cover over at least a portion of said multi-container package, said cover including a top panel and a pair of side panels on opposite ends of said top panel extending down from said top panel along opposite sides of said package, said top panel having a plurality of separated sections, each adjacent pair of said sections being interconnected by a pair of intermediate panels extending down into said package between a pair of adjacent ones of said assemblies; and (c) a band encircling and securing together said plurality of assemblies and said cover, and being in contact with both of said side panels, said band including a stabilizing strap extending between each adjacent pair of said assemblies and also extending between each pair of intermediate panels.

2. The package as recited in claim 1 wherein said cover is a paperboard cover, wherein said containers are cans arranged in two rows of three cans each in each of said assemblies, wherein each of said assemblies is preformed and secured together by an elastic loop matrix, wherein said plurality of assemblies is two assemblies, wherein said assemblies include six-containers, wherein said top panel consists of two sections, and wherein said band includes a single stabilizing strap.

3. The package as recited in claim 1 wherein said intermediate panels have a height approximately equal to that of said containers.

4. The package as recited in claim 1 wherein said pair of side panels extends down from said top panel on opposite sides of said package and have a height approximately equal to the height of said containers.

5. The package as recited in claim 1 wherein said band includes a handle integrally formed therewith.

6. The package as recited in claim 1 wherein said band is an elastic plastic band.

7. The package as recited in claim 1 wherein the hinge line between each side panel and the adjacent top section terminates short of the edge of the cover, at the apex of a notch in the edge of the cover, and whereby the adjacent edge of said side panel is curved by said band to conform to the curvature of said containers.

8. The package as recited in claim 7 wherein one side of said notch is a straight line in-line with said hinge line and the other side of said notch is a curved line in said top section that conforms to the curvature of said containers.

9. The package as recited in claim 1 wherein said top panel covers the entire top surface of all of said containers.

10. A method for making a multi-container package comprising the steps of:

(a) locating a plurality of preformed plural container assemblies side by side;

(b) providing a cover having a top panel, a pair of side panels on opposite ends of said top panel, and the top panel having a plurality of separate sections, each adjacent pair of which is interconnected by a pair of intermediate panels, over all of said assemblies such that said side panels extend down adjacent two opposite sides of said package, and such that each pair of said intermediate panels extend down between a respective pair of adjacent ones of said assemblies; and (c) positioning said cover; and (d) stretching an elastic band including at least one stabilizing strap over said assemblies and said cover, with a strap located in-between each pair of said intermediate panels, and then releasing said elastic band such that it contacts each of said side panels and securely holds said cover onto said assemblies and also securely holds said assembly together.

11. The method as recited in claim 10 wherein said cover positioning step includes positioning said top cover over the tops of said containers such that said cover completely covers all of the top surface of all of said containers.

12. The method as recited in claim 10 including providing a notch in said cover at opposite ends of each hinge line between each of said side panels and the adjacent top section, and providing each notch with one straight side and one curved side conforming to the curvature of said containers, such that said cover of the assembled package curves at the corners of the package in conformance to the curvature of the containers.

* * * * *